United States Patent [19]

Razdolsky

[11] Patent Number: 5,015,019

[45] Date of Patent: May 14, 1991

[54] LOCKING MECHANISM FOR EQUIPMENT CABINET

[75] Inventor: Robert Razdolsky, Wheeling, Ill.

[73] Assignee: Reliance Comm/Tec Corporation, Cleveland, Ohio

[21] Appl. No.: 510,941

[22] Filed: Apr. 19, 1990

[51] Int. Cl.[5] ..... E05B 5/02

[52] U.S. Cl. ..... 292/200; 70/208; 292/DIG. 31; 292/336.3; 292/210

[58] Field of Search ..... 292/336.3, DIG. 31, 292/200, 210, 226; 70/210, 208

[56] References Cited

U.S. PATENT DOCUMENTS

| | | | |
|---|---|---|---|
| 3,884,056 | 5/1975 | East et al. | 292/210 |
| 4,370,874 | 2/1983 | Nivnn | 292/DIG. 31 |
| 4,580,818 | 4/1986 | Lyng | 292/DIG. 31 |
| 4,706,478 | 11/1987 | Swan et al. | 292/336.3 |

FOREIGN PATENT DOCUMENTS

| | | | |
|---|---|---|---|
| 1286763 | 8/1972 | United Kingdom | 70/208 |

*Primary Examiner*—Eric K. Nicholson

*Attorney, Agent, or Firm*—R. A. Blackstone, Jr.

[57] ABSTRACT

A locking mechanism locks a door or panel over an opening to deter breach of the locking mechanism and prohibit unauthorized access. The locking mechanism includes an escutcheon plate which is non-removably secured to the door. This escutcheon plate has a front side and a back side, the front side facing outwardly away from the door and the back side being inserted through a mounting aperture in the door. A latch is operatively attached to the escutcheon plate. The latch is operated by a handle which is movably attached to the escutcheon plate on the outside of the door and which handle is formed with a blocking portion which extends to cover a specific area of the escutcheon plate. A catch member is mounted on the inside of the escutcheon plate and has an operating member which projects through the escutcheon plate to the outside of the escutcheon plate for engaging and disengaging the catch with the latch. Coverage of the escutcheon plate by the blocking portion includes covering access to this operating member.

16 Claims, 2 Drawing Sheets

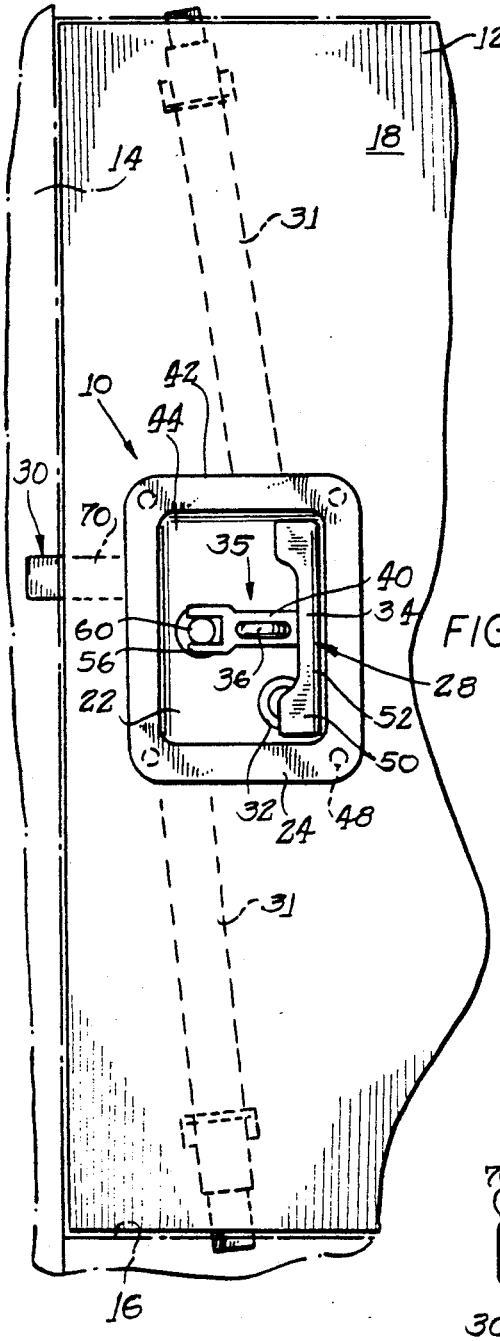
FIG.1
FIG.2
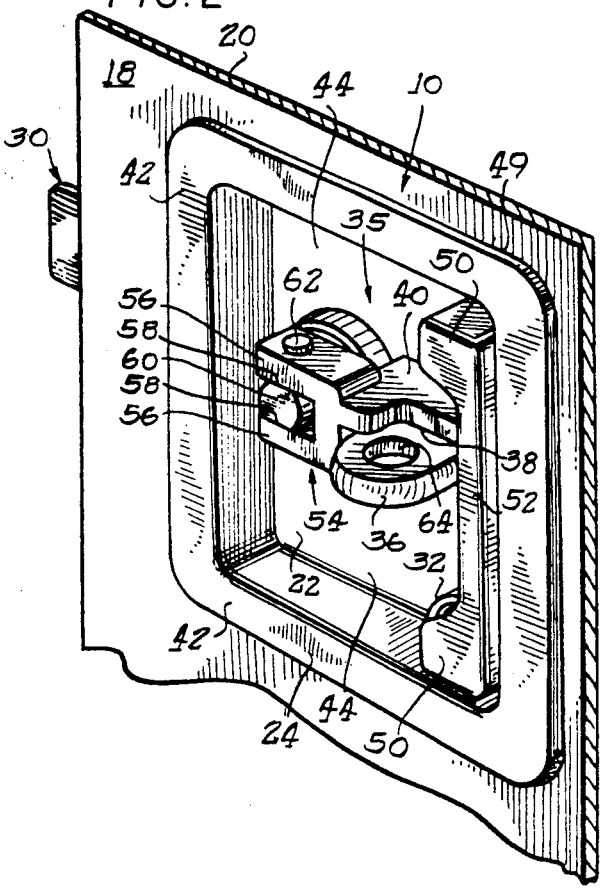
FIG.3
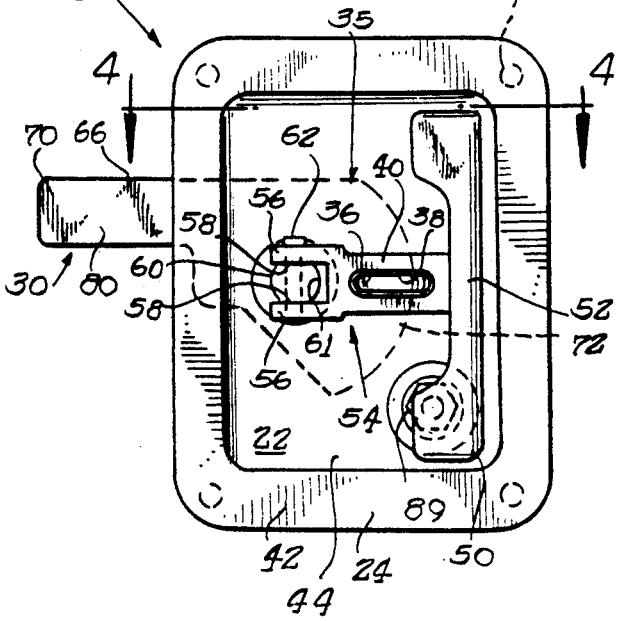

LOCKING MECHANISM FOR EQUIPMENT CABINET

BACKGROUND OF THE INVENTION

This invention relates to the locking mechanism arts and more particularly to a locking mechanism having a secondary catch for retaining a latch in a desired position.

The locking mechanism of the invention is employed for locking a door or panel to a surrounding frame. Typically, locking mechanisms for this application employ a locking control handle, which is provided on an exposed side of the door and is connected to a latch on the inner side of the door. The latch is operated by the handle to lock and unlock the door.

While prior art locking mechanisms provide a degree of security, they do not provide positive means to deter forcible breach of the door. For example, if the mechanism retaining the handle in position is broken such that the latch can be operated manually, the door can be unlocked. Nor does the prior art provide redundant locking mechanisms which secure a latch in place regardless of the condition of the handle on the outside of the door.

OBJECTS AND SUMMARY OF THE INVENTION

A general object of the present invention is to provide a locking mechanism which securely locks a door latch in a desired position.

Another object of the present invention is to provide a locking mechanism which has a rotatable, biased latch member and a "redundant" catch member which engages the latch to maintain it in a locked position regardless of the condition of a locking handle used to operate the latch.

Yet a further object of the present invention is to provide a locking mechanism which has a locking handle which, when in a locked position, obstructs access to a secondary locking member.

Briefly and in accordance with the foregoing, a locking mechanism has been developed to lock a door or panel over an opening to deter breach of the locking mechanism and prohibit unauthorized access. The locking mechanism includes an escutcheon plate which is secured to the door. This escutcheon plate has a front side and a back side, the front side facing outwardly away from the door and the back side being inserted through a mounting aperture in the door. A rotatable, biased latch is operatively attached to the escutcheon plate. The latch is operated by a handle which is movably attached to the escutcheon plate on the outside of the door and which handle is also formed with a blocking portion which extends to cover specific areas of the escutcheon plate. A catch member is mounted on the inside of the escutcheon plate and has an operating member which projects through the escutcheon plate to the outside of the escutcheon plate for engaging and disengaging the catch with the latch from the outside of the escutcheon plate. Coverage of the escutcheon plate by the blocking portion includes covering access to this operating member.

BRIEF DESCRIPTION OF THE DRAWINGS

The organization and manner of operation of the invention, together with the further objects and advantages thereof, may best be understood by reference to the following description taken in connection with accompanying drawings in which like reference numerals identify like elements in which:

FIG. 1 is a front view of a locking mechanism mounted on a door panel an equipment cabinet;

FIG. 2 is an enlarged perspective view of the locking mechanism;

FIG. 3 is an enlarged front view of the locking mechanism;

Figure 4:
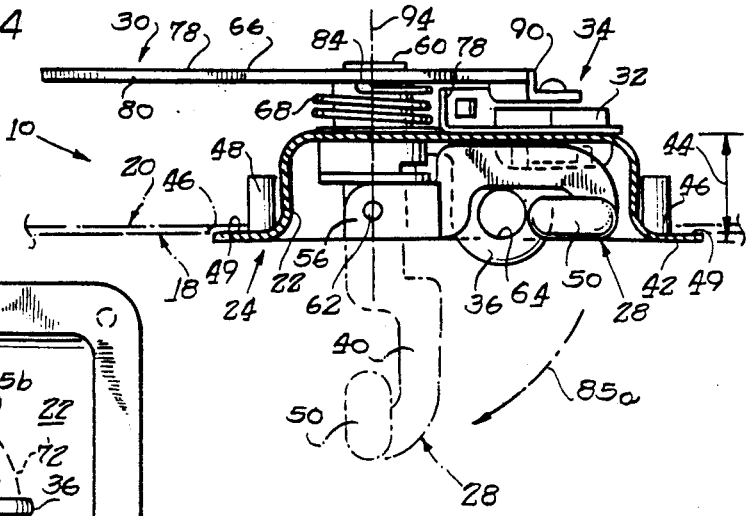
FIG. 4 is a cross-sectional side view of the locking mechanism taken along line 4—4 as illustrated in FIG. 3.
Figure 5:
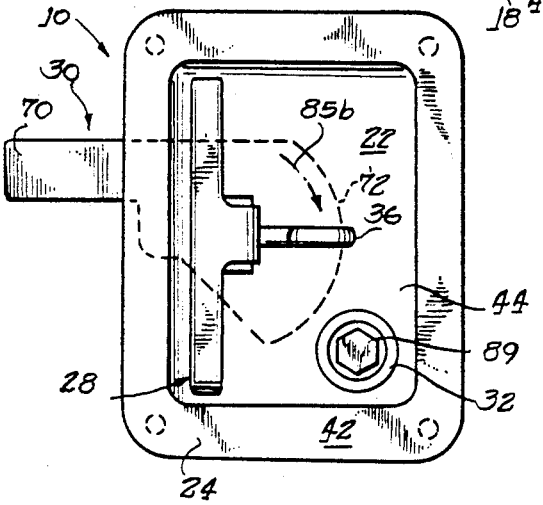
FIG. 5 is a front view showing a handle of the locking mechanism in a position moved away from an escutcheon plate of the locking mechanism.

It should be noted that dimensional relationships between the members of the illustrated embodiment may vary in practice and may have been varied in the illustrations to emphasize certain features of the invention.

DETAILED DESCRIPTION OF THE ILLUSTRATED EMBODIMENT

While this invention may be susceptible to embodiment in different forms, there is shown in the drawings and will be herein described in detail, a specific embodiment with the understanding that the present disclosure is to be considered an exemplification of the principles of the invention, and is not intended to limit the invention to the embodiment illustrated and described.

FIG. 1 provides a front view of a locking mechanism 10 mounted on a door panel 12 of an equipment cabinet 14. The cabinet 14 is formed with an access opening 16 and the door panel or cover portion 12 is mounted to the cabinet 14 in a manner to permit selectively covering and uncovering the access opening 16. In the closed position the locking mechanism 10 is employed to retain the cover portion 12 in the access opening 16 covering position. The door panel 12 has an outer surface 18 and an inner surface 20 (see FIG. 2).

The locking mechanism 10 includes an escutcheon plate 22 which is attachable to the outer surface 18 of the cover portion 12. The escutcheon plate 22 has a first side 24 at the outer surface 18 of the cover portion 12 and a second side 26 (see FIGS. 6 and 7) at the inner surface 20 of the cover portion 12. The first side 24 of the escutcheon plate 22 has a T-shaped handle 28 rotatably attached thereto which is operatively attached to latch means 30 which in turn are rotatably attached to the second side 26 of the escutcheon plate 22. Two locking bars 31 are shown in FIG. 1 as securing a top and bottom edge of the panel 12. These locking bars 31 are attached to the latch means 30 and are moved thereby for engaging and disengaging the door 12 relative to the opening 16.

Catch means 34 on the second side 26 of the escutcheon plate is selectively operable for releasably engaging the latch means 30 for holding the same (and locking bars 31) in the locked position, shown in FIG. 1. As will be described in greater detail hereinbelow, an operating portion 32 of catch means 34 (better shown in FIGS. 4, 6 and 7) projects through escutcheon plate 22 to facilitate operation of the catch means 34 on the second side 26 of the escutcheon plate 22 from the outside 18 of the cabinet 14. Handle engagement means 35 (best shown in FIG. 2) releasably retains the handle 28 in an inoperative position or locked position. The handle engagement means 35 includes a hasp or staple portion 36 attached to the first side 24 of the escutcheon plate 22 and an aperture 38 formed through a strap portion or upright portion 40 of the generally T-shaped handle 28, through which the staple 36 projects when the handle 28 is positioned thereover.

FIGS. 2 and 3 provide an enlarged perspective view and front view, respectively, of the locking mechanism 10 to facilitate further description of the details of the structures and functions of the locking mechanism 10. The first side 24 of the escutcheon plate 22 is formed with a peripheral flange area 42 and a central recessed area 44. The recessed area 44 projects into and through an aperture 46 of the door 12 (better shown in FIG. 4) and the flange area 42 overlies the outer surface 18 of the door or cover 12 surrounding the aperture 46. Threaded fastener studs 48 attached to a door panel facing side 49 of the flange area 42 are employed to secure the locking mechanism 10 to the cover portion 12.

The part of operating portion 32 of the catch means 34 which projects through escutcheon plate 22 is mounted in the recessed area 44 and is concealed by a blocking portion 50 of the handle 28 when the handle 28 is closed over the staple 36. The blocking portion 50 is formed on a distal end of a crossbar portion 52 of the handle 28 and is dimensioned and positioned to selectively prevent access to the operating portion 32. The strap portion 40 of the handle 28 extends from the crossbar portion 52 terminating in a fork 54. Legs 56 of the fork 54 extend around and positively engage flattened sides 58 of a shaft 60 which projects through an aperture 61 formed through the recessed area 44 of the first side 24 of the escutcheon plate 22 locking mechanism 10. As will be described in further detail hereinbelow, the shaft 60 on the second side 26 attaches to the latch means 30 to permit rotational operation thereof. A pin 62 extending through the legs 56 of the fork 54 and the shaft 60 operatively retains the handle 28 in engagement with the shaft 60. The strap portion 40 with the aperture 38 formed therethrough for receiving the staple 36 permits the handle 28 to be locked into the recessed area 44 when the panel is in the closed position, such that the external parts of the latch mechanism may be mounted flush with the cover surface 18.

The cross-sectional view of the locking mechanism 10 taken along 4—4 in FIG. 3 is illustrated in FIG. 4 to provide additional detail. As shown, the recessed area 44 projects through the aperture 46 of the cover portion 12. The latch means 30 overlies the second side 26 of the escutcheon plate 22. Mounted to the cover portion 12 as such, the locking mechanism 10 essentially flush mounts so that it does not protrude from the plane of the outer surface 18 of the cover portion 12. A portion of the staple 36 extends away from the plane of the outer surface 18 so that a locking device such as a padlock (not illustrated) may be inserted through an aperture 64 formed therethrough.

Figure 6:
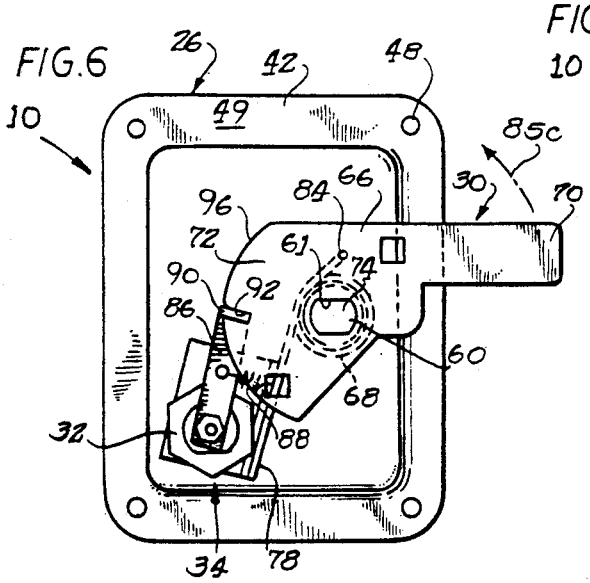
FIG. 6 is a back view of the locking mechanism showing the position of a latch and a catch which engages the latch.
Figure 7:
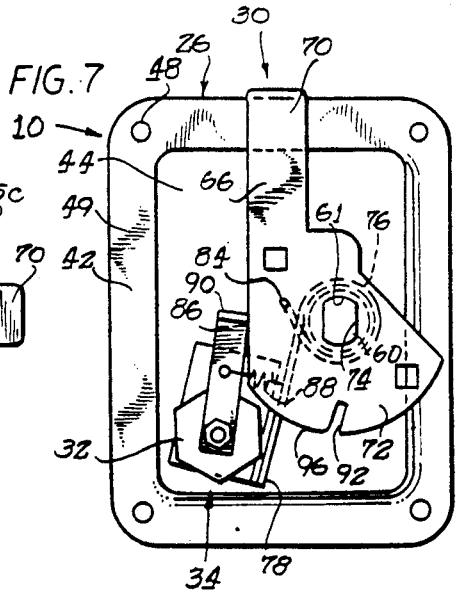
FIG. 7 is a view of the locking mechanism showing the operation of the latch when the catch and latch members are released to open the panel door.

Latch means 30 includes a latch member 66 operatively attached to the shaft 60 and biased by biasing means 68 to the position shown in FIG. 6 which is the locked position shown in FIG. 1. With additional reference to FIG. 6, the latch member 66 is formed with a bar portion 70 and a cam portion 72. A flat sided aperture 74 is formed through the cam portion 72 and is of complementary shape for receiving and retaining the shaft 60. The biasing means 68 is a coiled tension spring retained between a bracket 78 which projects inwardly of the escutcheon plate 22 and an aperture 84 in the outwardly facing surface 80 of the latch member 66.

With reference to FIGS. 4–7, the spring 68 is coiled to retain the latch member 66 in the latched position (as shown in FIG. 6). Prior to describing the operation of the locking mechanism, the catch means 34 will be described. With primary reference to FIG. 6 and additional reference to FIG. 4, the catch means 34 is described in further detail hereinbelow. As mentioned above, the locking mechanism 10 employs the catch means 34 to provide redundancy in locking the cover portion 12 over the access opening 16. The catch means 34 engage the latch member 66 to prevent movement of the latch member 66 even if access to and operation of the handle 28, which is attached to the same shaft 60 as the latch 66, is achieved.

Catch means 34 includes the operating portion 32, a catch bar 86 operatively attached to the operating portion 32 and biasing means 88. The operating portion 32 has a rotating tumbler device of known construction such as a rotatable shaft 87 having a tamper resistant head 89 operable only by a special tool, or a tumbler type lock. The catch bar 86 is attached to the operating portion 32 and in particular for the embodiment shown in FIGS. 6 and 7 to the shaft 87 such that rotation of the operating portion 32 also rotates the catch bar 86. A protruding stop portion 90 is formed on an end of the catch bar 86 distal to operating portion 32 and is engageable with a correspondingly formed receptacle 92 on the cam portion 72 of the latch member 66. The protruding stop portion 90 of the catch bar 86 is normally biased into engagement with the receptacle 92 by the biasing means 88, such as a tension spring drawn between the bracket 78 and catch bar 86. The biasing means 88 assures that the stop portion 90 will engage the receptacle 92 when the latch 66 is rotated to the appropriate position.

In use, the locking mechanism 10 is mounted to the cover portion 12 of an equipment cabinet 14. The locking mechanism 10 permits the cover portion 12 to be secured over the access opening 16 and provide a redundant securing function to prevent undesired entry into the equipment cabinet 14. The locking mechanism 10 includes an escutcheon plate 22 formed with a recessed area 44 and a flange area 42. A T-shaped handle 28 is accessible from a first side 24 of the escutcheon plate 22 and is operatively attached to latch means 30 located on a second side 26 of the escutcheon plate 22 by a common shaft 60. The handle 28 has handle engagement means 35 for retaining the handle 28 in an inoperable position when the cover panel 12 is closed.

To open a closed cover portion 12, a lock or other retaining device is removed from the aperture 64 of the staple 36. The handle 28 is raised out of the recessed area 44 by lifting up on the crossbar portion 52 as indicated in FIG. 4 by arrow 85*a* and phantom lined handle 28. As the handle 28 is raised, the legs 56 of the fork 54 rotate about the pivot pin 62 projecting through the legs 56 and the shaft 60. When the handle 28 is in parallel alignment with an axis 94 of the shaft 60 rotational torque applied thereto permits rotation of the latch member 66. However, the latch member 66 can be rotated only after the stop portion 90 of the catch bar 86 is disengaged from the receptacle 92. Further, the stop portion 90 cannot be disengaged from the receptacle 92 until the handle 28 has been raised to a position in parallel alignment with the axes 94 to provide access to the operating portion 32, since when the handle 28 is positioned in the recessed area 44 blocking portion 50 covers the operating portion 32 and in particular head 89.

Once the handle 28 is positioned in parallel alignment with the axis 94, the rotating tumbler device of operating portion 32 of the catch means 34 is operated to rotate the catch bar 86 to disengage the stop portion 90 from the receptacle 92 formed on the latch member 66. Having disengaged the stop portion 90 from the receptacle 92 the handle 28 may be rotated clockwise, and indicated by arrow **85*b*, to disengage the bar portions 70 and 31 from the latched position, whereupon the cover portion 12 may be moved to uncover the access opening 16. Arrow 85*c* in FIG. 6 indicates the resultant rotation of the latch member 66. Moving the latch member 66 from the position shown in FIG. 6 to that of FIG. 7 stresses the attached coiled spring 76 creating forces urging the latch member 66 back toward the latched position (as shown in FIG. 6**).

In securing the cover portion 12 over the access opening 16 employing the locking mechanism 10, essentially the reversed steps as described above are followed. The cover portion 12 is closed over the access opening 16 and the handle 28 is rotated counterclockwise to engage the bar portions 70 and 31. The coiled spring 68 biasedly rotates the latch member 66 into the latched position. Once the bar portion 70 is thus positioned, the stop portion 90 biasedly follows a curved edge 96 of the cam portion 72 and biasedly engages the receptacle 92 under the biasing force of the biasing means 88 attached to the catch bar 86 and the bracket 78. The rotating rumbler device is operated to return it to the position it had when the cover portion 12 was closed. Thus engaged, the handle 28 may be pivoted into the recessed area 44 whereupon the staple 36 projects through the aperture 38 formed in the upright portion 40. A locking device or other retaining member is inserted through the aperture 64 of the staple 36 to retain the handle 28 in the inoperable position in the recessed area as well as to secure the blocking portion 50 over the operating portion 32 of the catch means 34 to prevent undesired access thereto.

While a particular embodiment of the present invention has been shown and described in detail herein, it will be obvious to those skilled in the art that changes and modifications of the present invention, in its various aspects, may be made without departing from the invention in its broader aspects, some of which changes and modifications being matters of routine engineering or design, and others being apparent after study. As such, the scope of the invention should not be limited by the particular embodiment and specific construction described herein, but should be defined in the appended claims and equivalents thereof. Accordingly, the aim of the appended claims is to cover all such changes and modifications as fall within the true spirit and scope of the invention.

I claim:

1. A locking mechanism comprising an escutcheon plate having a first side and a second side, a handle portion movably attached to said first side of said escutcheon plate and latch means mounted to said second side of said escutcheon plate and operatively coupled to said handle means; said latch means including catch means mounted to said second side of said escutcheon plate and having an operating portion extending through said escutcheon plate for operation from said first side of said escutcheon plate, said catch means being engageable with said latch means for releasably retaining said latch means in a predetermined position, biasing means for releasably biasing said catch means into engagement with said latch means when said latch means are moved into said predetermined position; a handle locking member for releasably locking said handle portion in an operable position and a blocking portion formed on said handle portion for selectively preventing operational access to said operating portion of said catch means from said first side of said escutcheon plate.

2. A locking mechanism according to claim 1, wherein said handle portion is T-shaped, an upright portion of T-shaped handle being operatively attached to said latch and a crossbar portion of said T-shaped handle being formed perpendicular to said upright portion.

3. A locking mechanism according to claim 2, wherein said engagement means includes a staple attached to said escutcheon plate and an aperture formed through said T-shaped handle for receiving said staple a lock removably engageable with said staple for removably locking said handle means in an inoperable position.

4. A locking mechanism according to claim 2, wherein said crossbar portion of said T-shaped handle is formed with said blocking portion on a distal end thereof for preventing access to said operating portion positioned therebehind.

5. A locking mechanism according to claim 1, wherein said latch means has an elongate locking bar portion extending therefrom for engaging a surface to provide locking action when engaged with said surface.

6. A locking mechanism according to claim 1, wherein said escutcheon plate is formed with a recessed area in which said handle means is positionable for flush mounting said locking mechanism relative to a surface to which it is attached.

7. A locking mechanism according to claim 1, wherein said catch means is formed with a stop portion which engages a cooperatively formed receptacle on said latch means for engaging said latch means when said latch means is in a locking position to retain said latch means in a locking position independently of said handle means being retained by said engagement means.

8. A locking mechanism for retaining a body to which it is attached in a desired position, said locking mechanism comprising escutcheon plate attachable to a body, said escutcheon plate having a first side and a second side; handle means movably attached to said first side of said escutcheon plate; latch means mounted to said second side of said escutcheon plate and operatively coupled to said handle means; catch means operable from said first side of said escutcheon plate and engageable with said latch means on said second side of said escutcheon plate for releasably engaging and retaining said latch means in a desired position; biasing means for releasably biasing said catch means for engagement with said latch means when said latch means are moved into said desired position; said handle means including handle locking means for releasably locking said handle means in an inoperable position and a movable blocking portion for selectively preventing operation of said catch means positioned therebehind from said first side of said plate portion.

9. In combination with a cabinet having a body portion formed with an access opening an a cover portion removably attachable to said body between open and closed positions for selectively covering and uncovering said access opening, a locking mechanism including an escutcheon plate attachable to said cover portion and having a first side at an outer surface of said cover portion when in said closed position relative to said body portion and a second side at an inner surface of said cover portion when in said closed position relative to said body portion; latch means operatively attached to said second side of said escutcheon plate and engageable with said body portion for retaining said cover portion in said closed position; catch means mounted to said second side of said escutcheon plate and biased for releasably retaining said latch means in a desired position, said biased catch means being operable from first side of said escutcheon plate for disengaging said catch means from said latch; handle means movably attached to said first side of said escutcheon plate and operatively coupled to said latch means for controlling the position of said latch means relative to said body portion, said handle means having a blocking portion formed thereon for selectively preventing operation of said catch means from said first side of said escutcheon plate; and handle locking means for engaging said handle means for releasably retaining said handle means in a fixed position.

10. A locking mechanism according to claim 9, wherein said handle portion is T-shaped, an upright portion of said T-shaped handle being operatively attached to said latch means and a crossbar portion of said T-shaped handle being formed perpendicular to said upright position.

11. A locking mechanism according to claim 9, wherein said engagement means further includes a staple attached to said escutcheon plate and an aperture formed through said upright portion of said T-shaped handle for receiving said staple for engageably retaining said handle means and a lock member engageable with said staple for selectively locking said handle means in an inoperable position.

12. A locking mechanism according to claim 10, wherein said crossbar portion of said T-shaped handle is formed with said locking portion on at least one distal end thereof.

13. A locking mechanism according to claim 9, wherein said latch means has an elongate locking bar portion extending therefrom for engaging a surface of said body portion of said cabinet for providing locking action when said locking bar is engaged with said surface.

14. A locking mechanism according to claim 9, wherein said escutcheon plate is formed with a recessed area in which said handle means is postionable for flush mounting said locking mechanism relative to said cover portion.

15. A locking mechanism according to claim 9, wherein a stop portion is formed on said catch means for engaging a cooperatively formed receptacle on said latch means for retaining said latch means in a locked position independently of said handle means being retained by said engagement means.

16. A locking mechanism according to claim 15 and further including biasing means operatively coupled to said catch means and said latch means for biasedly engaging said stop portion of said catch means with said receptacle on said latch means.

* * * * *